US010703538B2

(12) United States Patent
Shamp et al.

(10) Patent No.: US 10,703,538 B2
(45) Date of Patent: Jul. 7, 2020

(54) COMPARTMENTALIZATION SYSTEM FOR INDUSTRIAL TOTES AND COMPARTMENTALIZABLE TOTES

(71) Applicant: AKRO-MILS, a division of Myers Industries, Inc., Akron, OH (US)

(72) Inventors: Travis Shamp, Akron, OH (US); Albert Kobilarcik, Wooster, OH (US)

(73) Assignee: AKRO-MILS, a division of Myers Industries, Inc., Akron, OH (US)

( * ) Notice: Subject to any disclaimer, the term of this patent is extended or adjusted under 35 U.S.C. 154(b) by 44 days.

(21) Appl. No.: 15/970,971

(22) Filed: May 4, 2018

(65) Prior Publication Data

US 2018/0251263 A1 Sep. 6, 2018

Related U.S. Application Data

(63) Continuation-in-part of application No. 13/671,978, filed on Nov. 8, 2012, now abandoned.

(60) Provisional application No. 61/557,168, filed on Nov. 8, 2011.

(51) Int. Cl.

| | |
|---|---|
| ***B65D 21/032*** | (2006.01) |
| ***B65D 25/06*** | (2006.01) |
| ***B65D 25/20*** | (2006.01) |
| ***B65D 21/02*** | (2006.01) |

(52) U.S. Cl.

CPC ..... *B65D 25/06* (2013.01); *B65D 21/0233* (2013.01); *B65D 25/20* (2013.01)

(58) Field of Classification Search

CPC ..... B65D 21/0233; B65D 25/20
USPC ..... 220/23.86, 23.4, 23.89, 23.83
See application file for complete search history.

(56) References Cited

U.S. PATENT DOCUMENTS

| | | | | | |
|---|---|---|---|---|---|
| 4,756,425 | A * | 7/1988 | Wise | A23B 7/10 | 206/518 |
| 4,889,254 | A * | 12/1989 | Vola | A45C 7/0045 | 220/23.4 |
| 5,117,997 | A * | 6/1992 | Fink | A61B 50/36 | 206/510 |
| 5,454,478 | A * | 10/1995 | Everson | A45C 13/02 | 220/23.83 |

* cited by examiner

*Primary Examiner* — Stephen J Castellano
(74) *Attorney, Agent, or Firm* — Dureska & Moore, LLC; Brent L. Moore; David P. Dureska

(57) ABSTRACT

A compartmentalization system for an industrial tote includes a base; side walls, which include recesses for retaining bins within the tote; and end walls. The tote may include eight recesses in each side wall for receiving a pair of inserts on a bin. The bins typically include two or four tabs. The bins that are used with the tote system include a base, opposed side walls, and end walls that define the interior of the bin. Typically, a lip formed at the top of the side and end walls to improve strength and stability. The tabs are formed on the exterior of at least one side wall. The tab is inserted into the recess in the tote. Each tab includes a riser that is substantially normal to the sidewall and a tab formed at the end of the riser so that the tab is spaced apart from the sidewall.

5 Claims, 17 Drawing Sheets

COMPARTMENTALIZATION SYSTEM FOR INDUSTRIAL TOTES AND COMPARTMENTALIZABLE TOTES

CROSS-REFERENCE TO RELATED APPLICATION

This application is a continuation-in-part of application Ser. No. 13/671,978 filed on Nov. 8, 2012, now abandoned, which claims the benefit of U.S. Provisional Patent Application 61/557,168 filed Nov. 8, 2011.

BACKGROUND

Bins and bin systems are often used in industrial assembly. Often the bins filled with a number of parts and are moved along a conveyor from one location to the next. A large installed base of conveyor systems exists. The bins typically carry a single part or loose boxes of parts so that it is difficult to efficiently move parts through the conveyor system. Such bin conveyors are shown in U.S. Pat. No. 7,954,627 entitled "Bin Transporter System" showing Brian C. Weed et al. as inventors. Another patent showing such a conveyor system is U.S. Pat. No. 7,809,467 entitled "System and Method for order Picking of Articles into Order Containers" showing Gerhard Schaefer as inventor.

SUMMARY OF THE INVENTION

In accordance with embodiments of the present invention, a compartmentalization system for industrial totes and compartmentalized totes and bins therefor are presented. The tote of the present invention include a base, side walls, which include recesses for retaining bins within the tote and end walls. As shown, the tote of the present invention includes a base, a first wall and a second side wall, each of side walls including a plurality of recesses for retaining a bin insert within the tote; and first and second end walls, the base, side walls and end walls defining a tote interior. Also disclosed is a bin for use in a compartmentalizable tote system, having a base; side walls; end walls forming a bin interior and a tab formed on the exterior of at least a first side wall, the tab being suitable for insertion into a recess formed in a first sidewall of a compartmentalizable tote system.

BRIEF DESCRIPTION OF THE DRAWINGS

A more complete appreciation of the invention and the many embodiments thereof will be readily obtained as the same becomes better understood by reference to the following detailed description when considered in connection with the accompanying drawings, wherein.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figure 1:
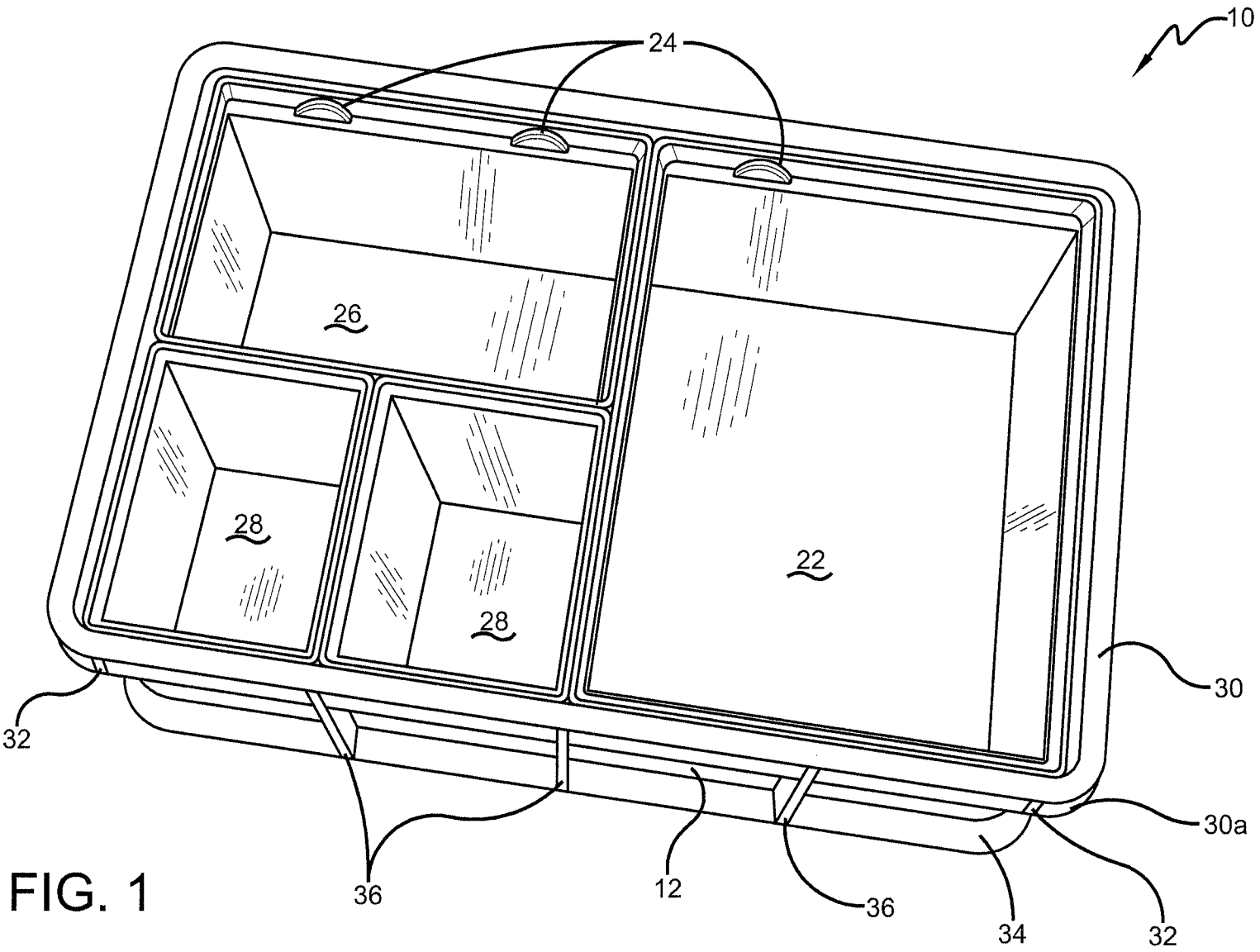
FIG. 1 illustrates an isometric view of the tote system with inserted bins of the present invention.
Figure 1A:
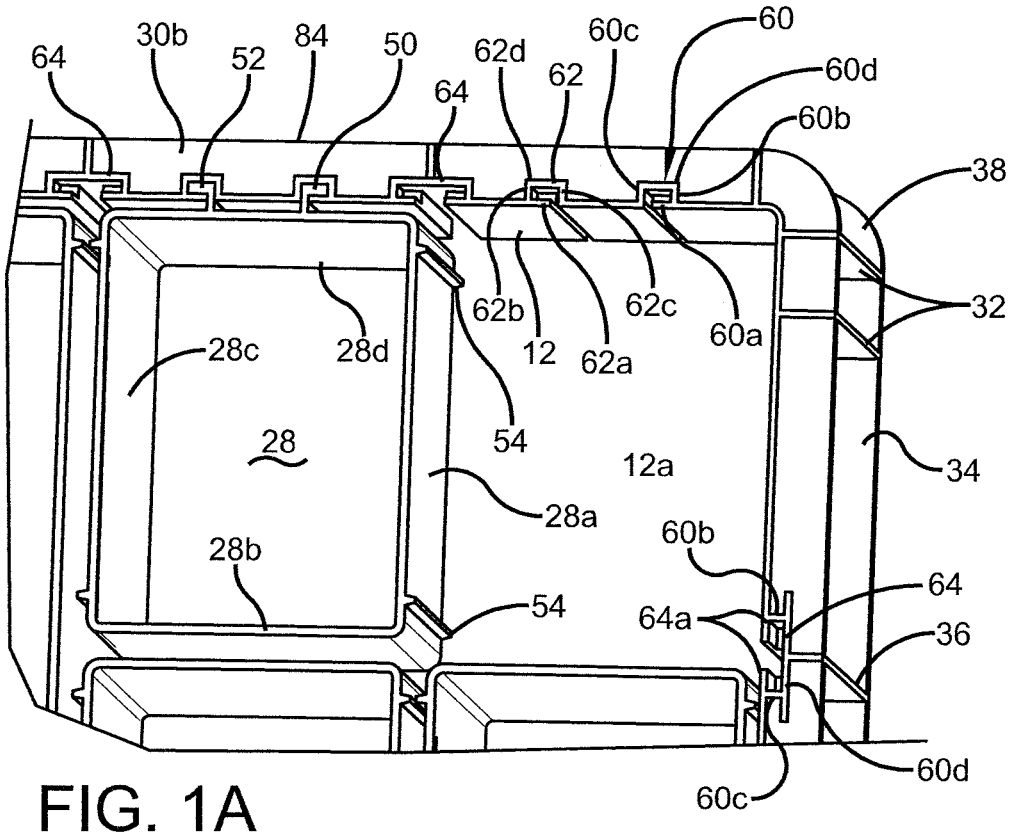
FIG. 1A illustrates an isometric, cross sectional view, in detail of the inserted bin retention system.

A compartmentalizable tote system is shown in FIG. 1 and FIG. 1A. The tote system includes a tote and one or more bins that may be secured within the tote. As shown in FIG. 1 and FIG. 1A the tote system may include a number of bins of different sizes and shapes. The bins are typically secured within the tote by a tab system on the side walls. As shown in FIG. 1, a tote 10 is provided with side walls 12 that may contain, a half-sized bin insert 22, a quarter-size bin insert 26 and two eighth-size bin inserts 28. The bin inserts may optionally include handles 24. The tote 10 may include a reinforcing rim 30 and a secondary rim 30*a* formed on the upper portion of sidewalls 12 and a lower rim 34. Also included on sidewalls 12 are vertical tote reinforcements 36 and rim reinforcements 32 as well as a lower rim 34. The various bin inserts 22, 26, 28 may be used in any combination based on the needs of the facility using the totes.

Figure 6:
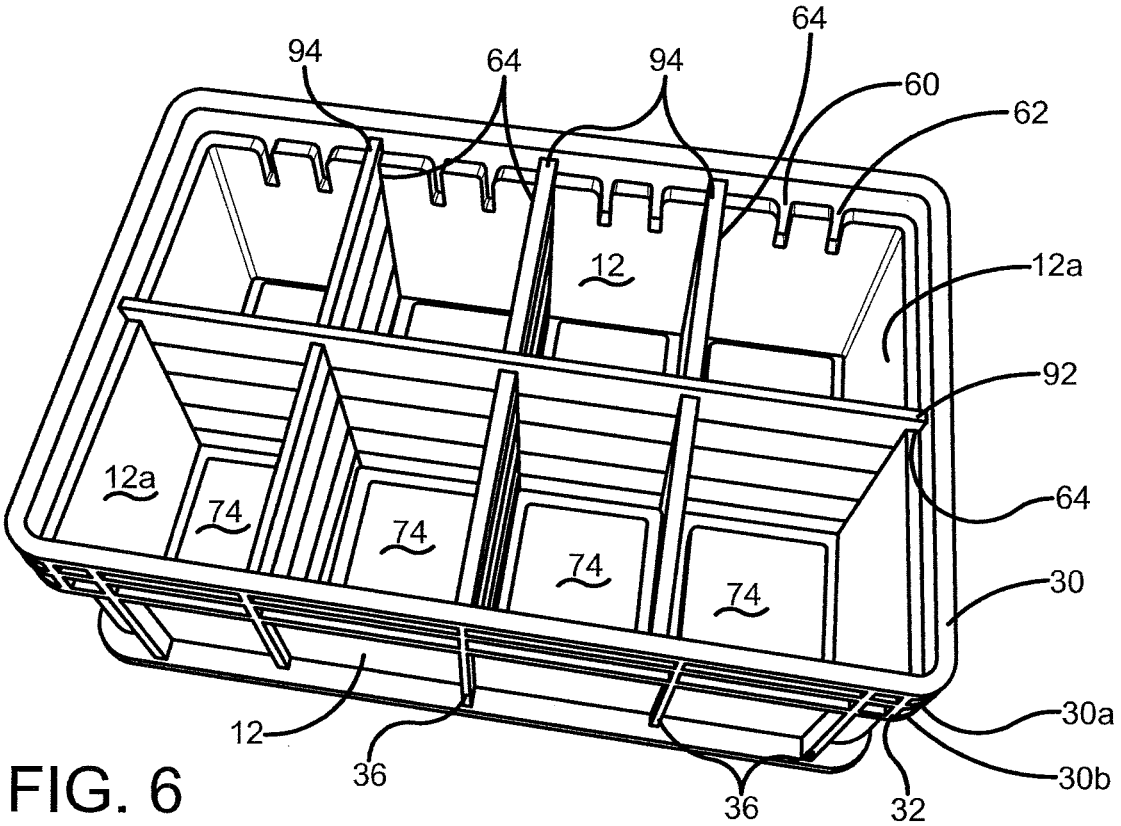
FIG. 6 illustrates an isometric view of a tote with dividers inserted in an alternate embodiment of the present invention.

The bin insert retaining system is shown in FIG. 1A, first and second tote sidewalls 12 include recesses for retaining bin inserts within the tote. The bin insert may include any number of recesses in each side wall. Preferably, the recesses 50, 52 are paired so each pair of recesses receives a pair of inserts on a bin 28. A second type of recess 64 may be provided for the insertion of divider walls (as shown in FIG. 6). Bin insert 28 includes side walls 28*a*, 28*b*, 28*c*, 28*d* and sidewalls 28*a* and 28*c* may include stack ribs 54. Stack ribs 54 are provided to inhibit the jamming of empty bin inserts 28 when stacked. The bin insert 28 also includes at least one retaining tab 50, 52 each having a spacer 84 that displaces tab 50, 52 from sidewall 28*d* of bin insert 28. While tabs 50, 52 are shown turning to opposite sides they tab 52 may be of any suitable configuration, such as toward the exterior of the bin insert, toward the interior of the bin insert or spacer 84 may be located toward the center of tabs 50, 52 so that no apparent left or right turn is present. Tabs 50, 52 are received in slots 60, 62. Each slot 60 includes a front wall 60*a*, side wall 60*c*, back wall 60*d* and distal wall 60*b*. The walls 60*a*, 60*b*, 60*c* and 60*d* enclose slot 60, which receives the tab 50 while spacer 84 fits between front wall 60*a* and side wall 60*c*. Similarly, as shown walls 62*a*, 62*b*, 62 *c* and 62 *d* are formed in tote wall 12 to receive tab 52. A second configuration for a slot 64 in sidewall 12*a* is shown in FIG. 1A in which the groove 64 is defined by two front walls 60*a*, side walls 60*b*, 60*c* and a back wall 60*d*. Reinforcing rim 30 and secondary rim 30*a* formed on the upper portion of sidewalls 12 and rim reinforcements 32 provide a stiff and rugged tote for the bins.

Figure 2:
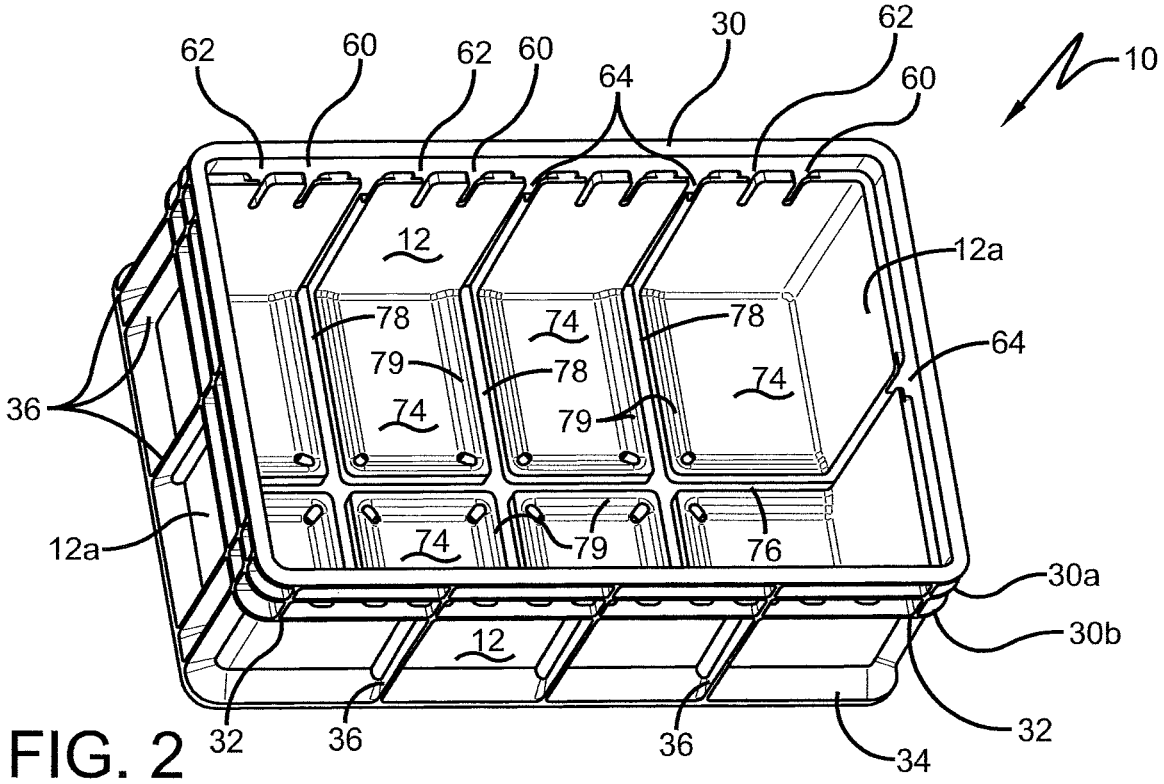
FIG. 2 illustrates an isometric view of the tote system of the present invention, without the inserted bins.

The tote 10 as shown in FIG. 2 includes sidewalls 12 having recesses 60, 62 for retaining bin inserts within the tote. The sidewalls 12 and sidewalls 12*a* include slots 64 for retaining dividers 94 (as shown in FIG. 6). The bin insert may include any number of recesses 60, 62 or slots 64 in each side wall. Tote 10 includes reinforcing rim 30 and secondary rims 30*a*, 30*b* formed on the upper portion of sidewalls 12 and rim reinforcements 32 provide a stiff and rugged tote for the bins. Walls 12, 12*a* are formed with vertical structural beams 36 between upper rims 30, 30*a*, 30*b*, and lower rim 34. The base of the tote includes channels 64 that receive tote dividers. The base also may include channel features 79 that define base sections 74 on which the internal bins rest. Preferably the internal bins include a lower lip that mates with the step down features 79 to inhibit movement of the bins within tote 10.

Figure 2A:
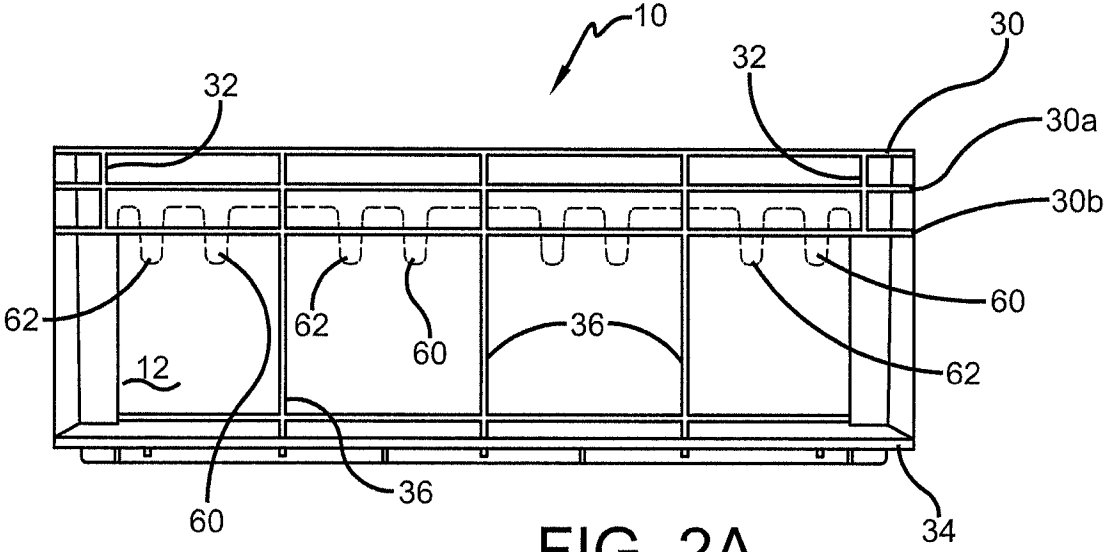
FIG. 2A illustrates a plan view of the tote system of the present invention, showing molded fixtures in the sidewall of the tote.

The side of tote 10 is shown in FIG. 2A. As with FIG. 2, the tote includes sidewalls 12 having recesses 60, 62 for retaining bin inserts within the tote. The sidewall 12 includes reinforcing rim 30 and secondary rims 30*a*, 30*b* formed on the upper portion of sidewalls 12 and rim reinforcements 32 and vertical structural beams 36 between upper rims 30, 30*a*, 30*b*, and lower rim 34. The base of tote 10 is typically smaller than the inner edge of the rim 30 so that multiple totes may be stacked vertically.

Figure 3:
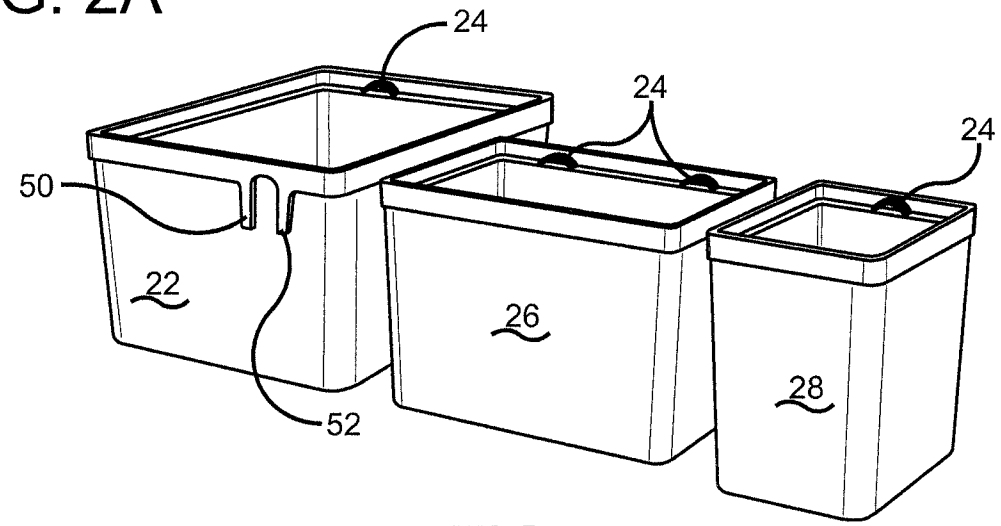
FIG. 3 illustrates an isometric view of bin inserts in accordance with the present invention.

Three internal bins 22, 26, 28 are shown in FIG. 3. The bins 22, 26, 28 typically include two or four tabs 50, 52 depending on the size of the bin. While it may be preferable to have tabs on opposite sides of half size bin 22 it is not necessary to maintain a stable fit. It is also possible to manufacture bins of any size and that included eight tabs or more tabs. Typically at least one handle 24 is molded into the bins 22, 26, 28.

Figure 3A:
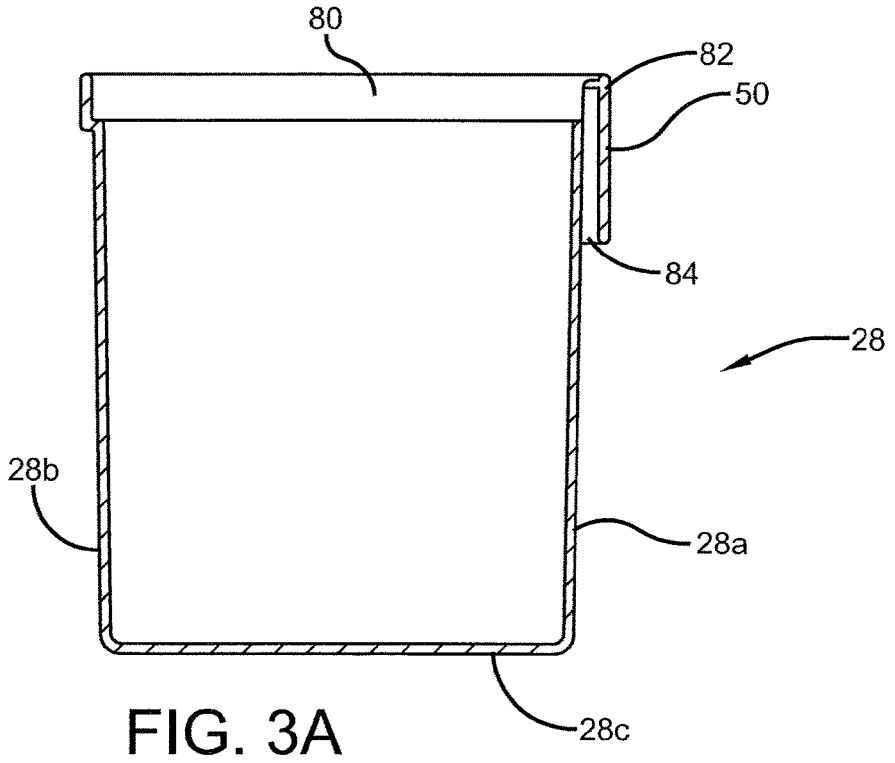
FIG. 3A illustrates a cross sectional view of a bin insert in accordance with the present invention.

FIG. 3A shows a bin 28 including base 28*c*, side walls 28*a*, 28*b* and upper rim 80. The upper rim 80 and sidewall 28*a* are integrally formed with tab 50. Preferably, tab 50 is spaced apart from sidewall 28*a* by spacer 84 and an upper reinforcement 82. The gap between tab 50 and sidewall 28*a* is preferably slightly greater than the thickness of front wall 62*a* of slot 60 (as shown in FIG. 1A). The tab 50 is releasably retained within slot 60.

Figure 3B:
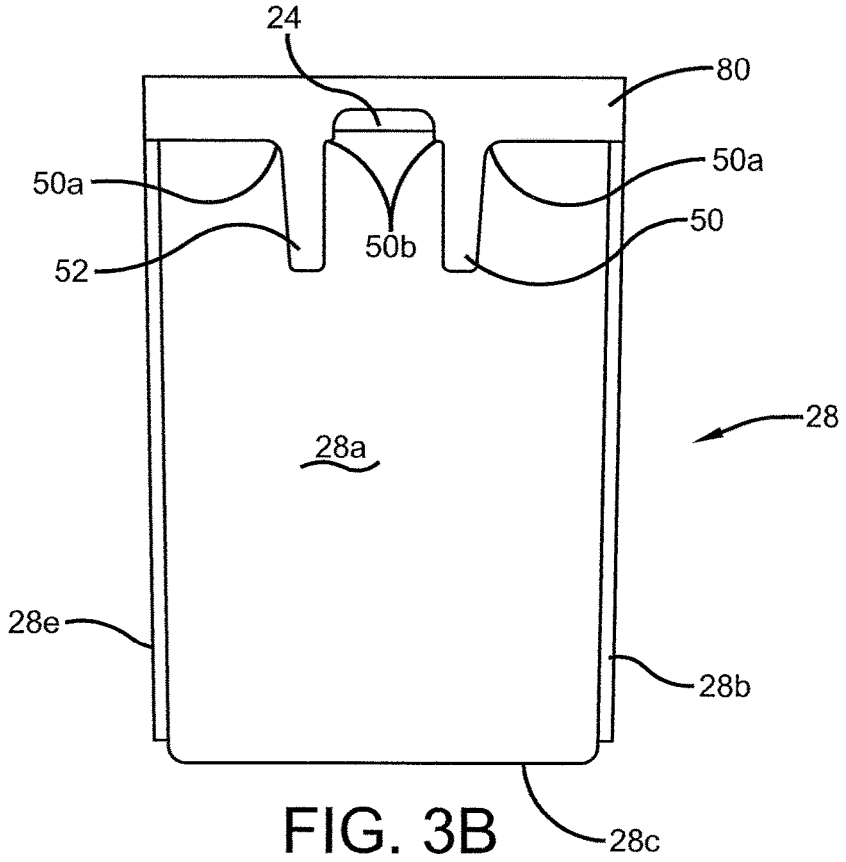
FIG. 3B illustrates a plan view of a bin insert in accordance with the present invention.

As shown in FIG. 3B, the bin 28 may include base 28*c* and side walls 28*a*, 28*b*, 28 *e*, one or more handles 24 and one or more tabs 50, 52. One suitable shape for the tabs 50, 52 is trapezoidal. The trapezoidal shape being wider at the top and tapering to a narrower width at the bottom provides for easier insertion of the bin and improved stability of the bin once installed. Each tab 50, 52 include may include a projection 50*b* and an arcuate section 50*a* formed in rim 80 that form a stop so that tabs 50, 52 do not jam into their respective slots.

Figure 3C:
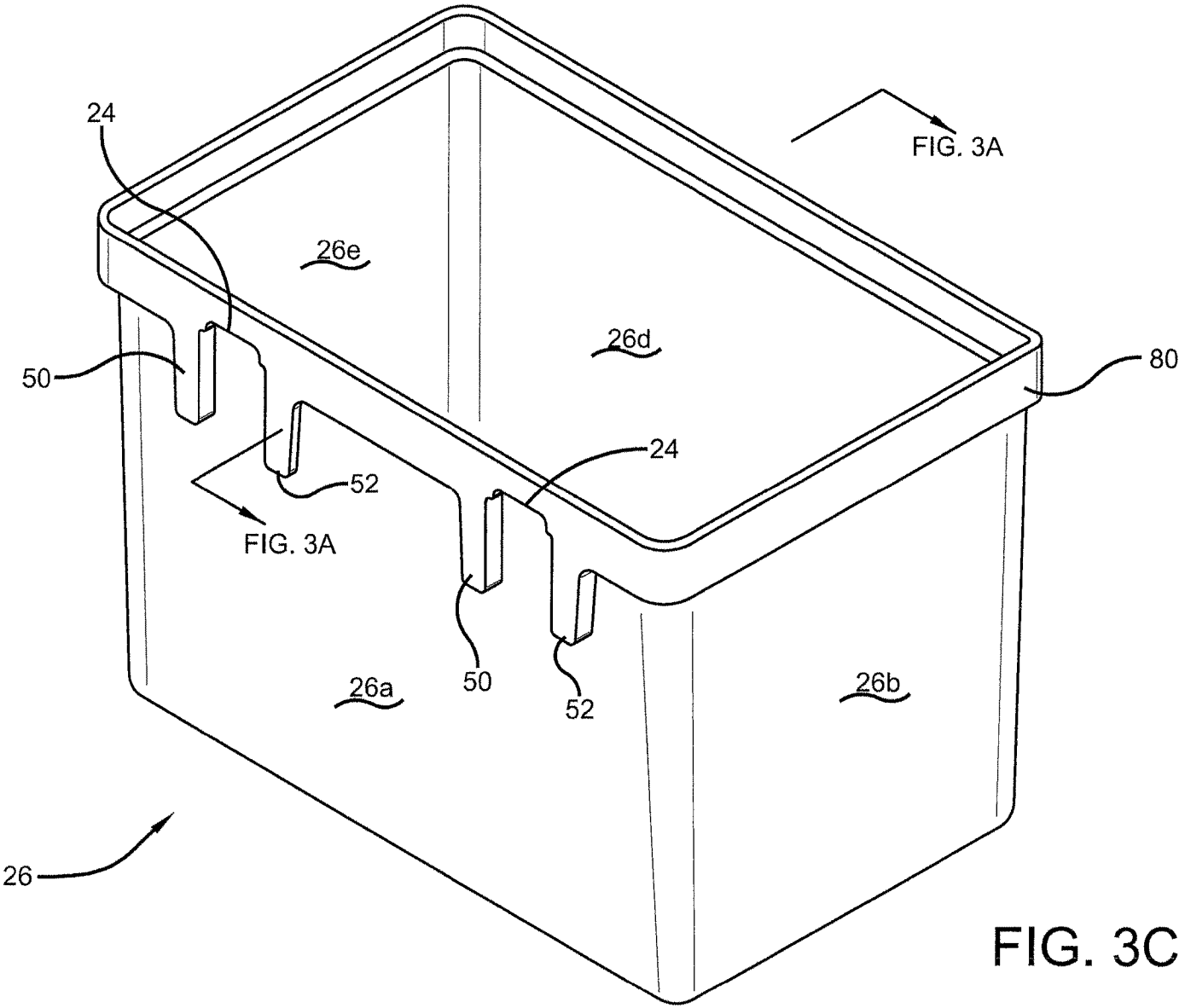
FIG. 3C illustrates an isometric view of a bin insert in accordance with the present invention.

As shown in FIG. 3C, the bin 26 may include side walls 26*a*, 26*b*, 26 *d*, 26*e*, one or more handles 24 and one or more tabs 50, 52 formed in rim 80. One suitable shape for the tabs 50, 52 is trapezoidal. The quarter size bin 26 will generally include two pairs of tabs 50, 52 for secure retention within the tote.

Figure 3D:
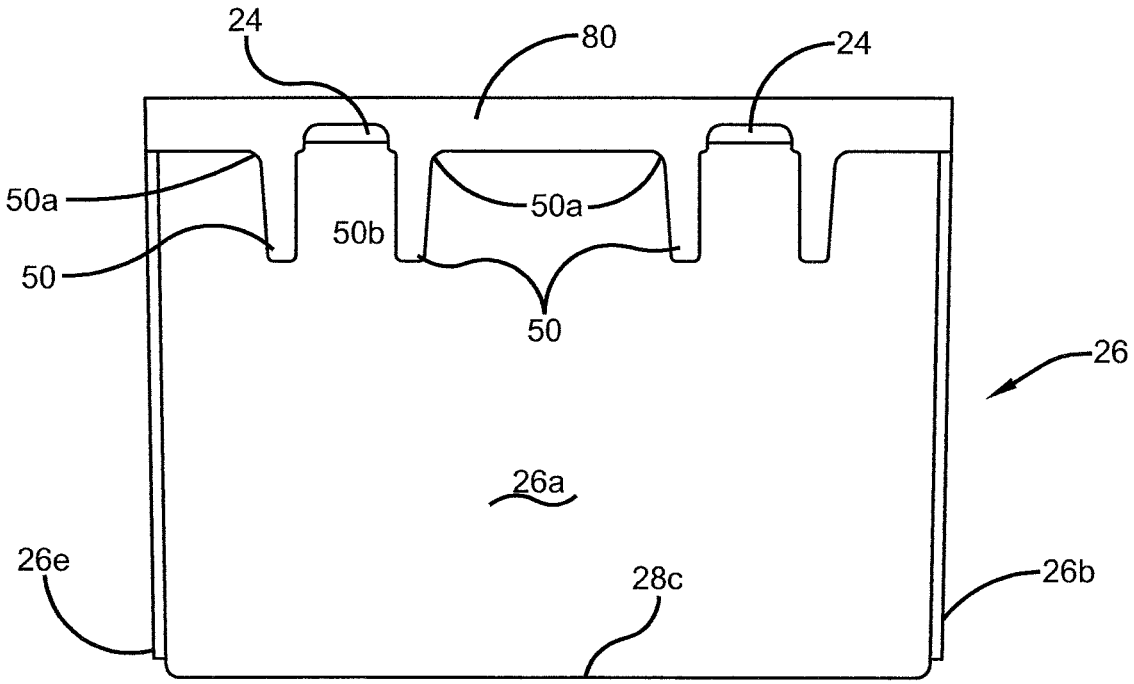
FIG. 3D illustrates a plan view of a bin insert in accordance with the present invention.
Figure 3E:
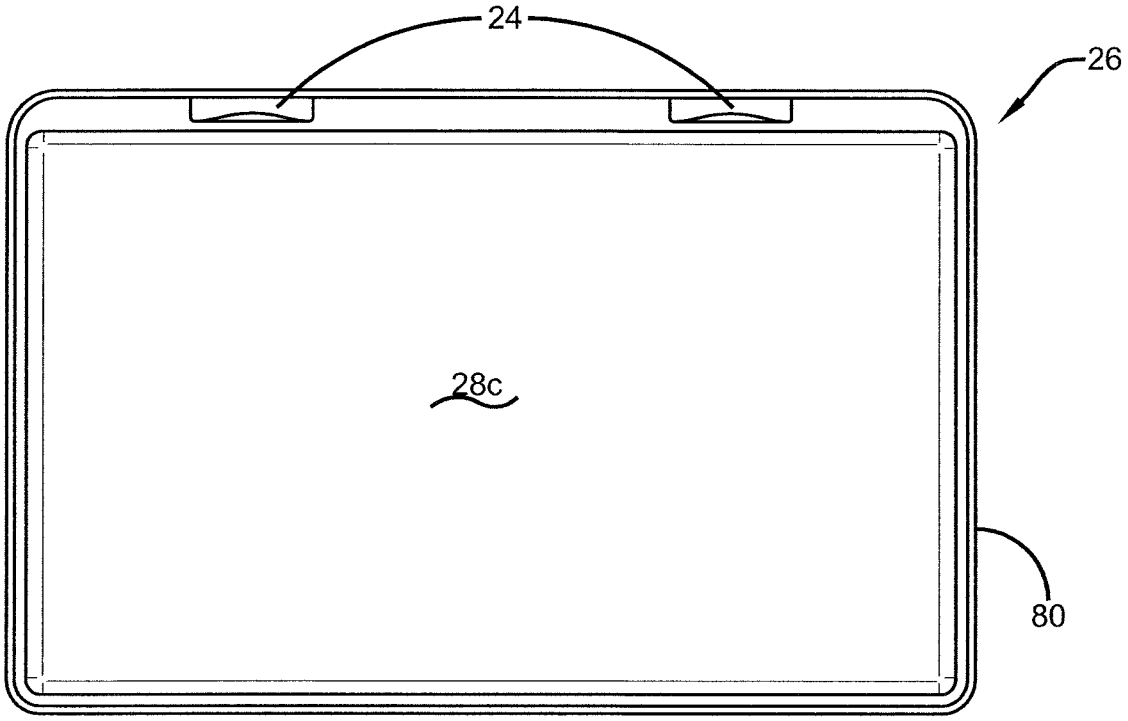
FIG. 3E illustrates an elevational view of a bin insert in accordance with the present invention.

As shown in FIG. 3D, the quarter sized bin 26 may include side walls 26*a*, 26*b*, 26*e*, base 28*c*, one or more handles 24 and one or more tabs 50, 52 formed in rim 80. As discussed above, with respect to FIG. 3B, one suitable shape for the tabs 50, 52 is trapezoidal. Each tab 50, 52 include may include a projection 50*b* and an arcuate section 50*a* formed in rim 80 that form a stop so that tabs 50, 52 do not jam into their respective slots. The use of two pairs of tabs 50, 52 provide sufficient stability when inserted. FIG. 3E shows a top view of bin 26 as shown in FIG. 3D, showing the position of handles 24 formed in rim 80 over tabs 50, 52. Also shown is base 28*c*.

Figure 4:
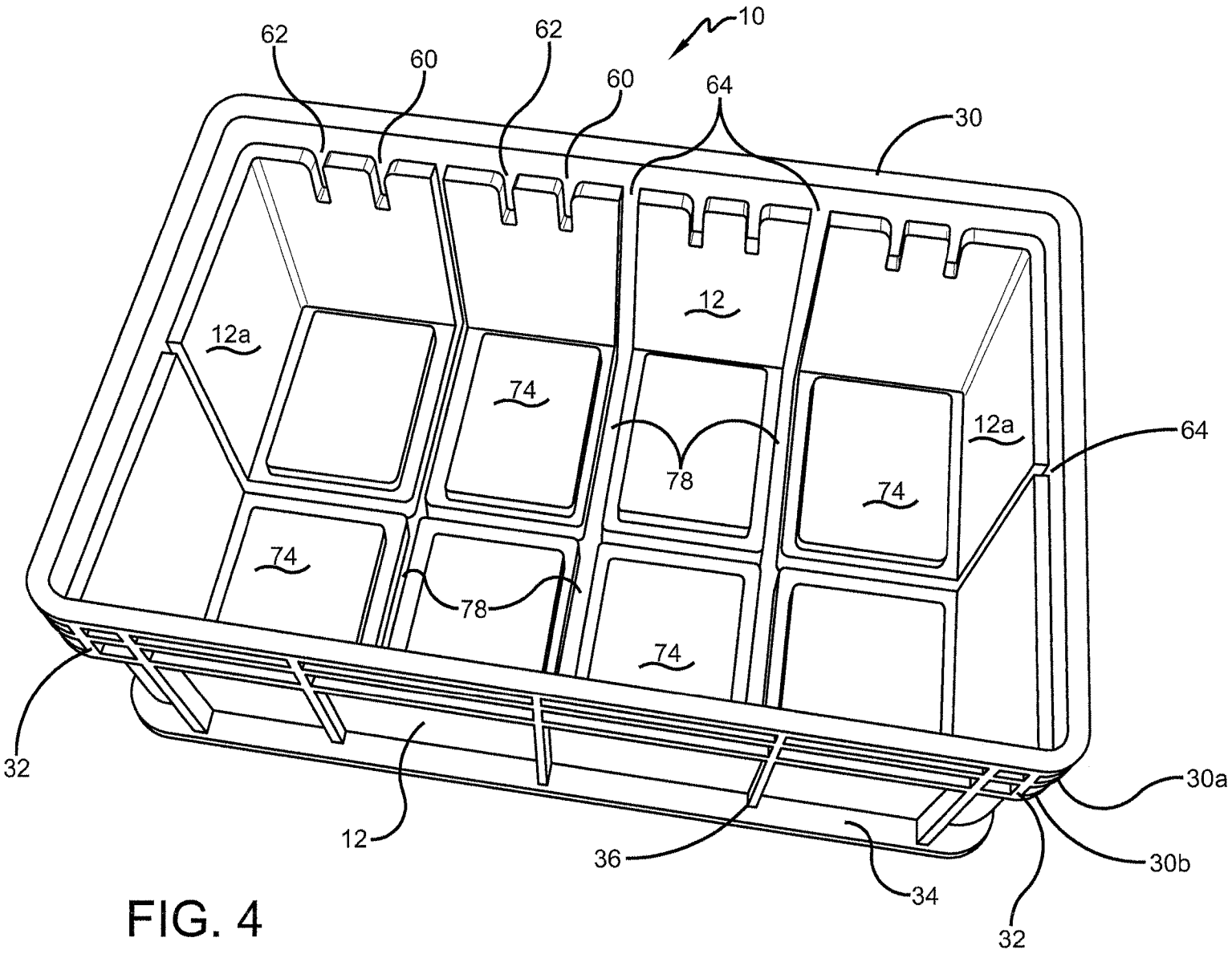
FIG. 4 illustrates an isometric view of a tote in an alternate embodiment of the present invention.

An alternate embodiment of the tote 10 is shown in FIG. 4. The tote includes sidewalls 12 having recesses 60, 62 for retaining bin inserts within the tote. The sidewalls 12 and sidewalls 12*a* include slots 64 for retaining dividers 94 (as shown in FIG. 6). The bin insert may include any number of recesses 60, 62 or slots 64 in each side wall. Tote 10 includes reinforcing rim 30 and secondary rims 30*a*, 30*b* with rim reinforcements 32 formed on the upper portion of sidewalls 12, 12 *a*. Rim reinforcements 32 interconnecting rims 30, 30*a*, 30*b* provide a stiff and rugged tote for the bins. Slots 64 are formed in side wall 12 as are rim reinforcing members 36. Walls 12, 12*a* are formed with vertical structural beams 36 between upper rims 30, 30*a*, 30*b*, and lower rim 34. The base of the tote includes channels 64 that receive tote dividers and define base step down features 79 and base sections 74 on which the internal bins rest.

Figure 5:
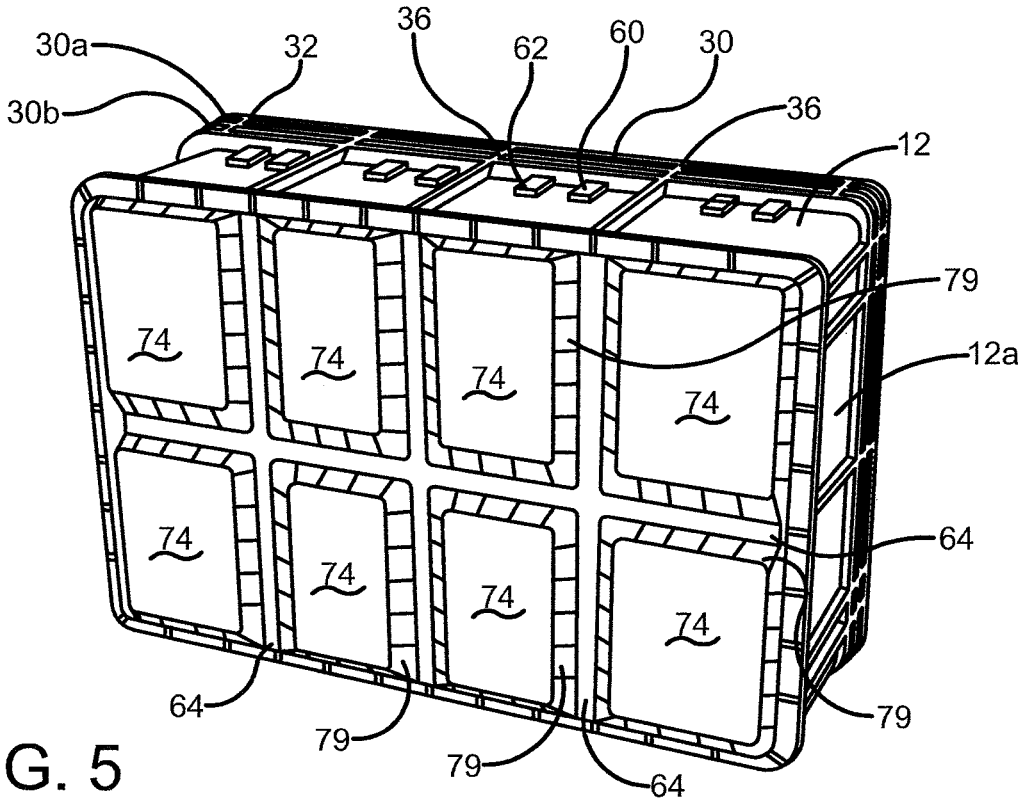
FIG. 5 illustrates an isometric view of the bottom of a tote in an alternate embodiment of the present invention.

FIG. 5 shows the alternate embodiment of the tote 10 as shown in FIG. 4. The tote includes sidewalls 12 having recesses 60, 62 for retaining bin inserts within the tote. The sidewalls 12 and sidewalls 12*a* include slots 64 for retaining dividers 92, 94 (as shown in FIG. 6). The tote may include any number of recesses 60, 62 or slots 64 in each side wall. Tote 10 includes reinforcing rim 30 and secondary rims 30*a*, 30*b* with rim reinforcements 32 formed on the upper portion of sidewalls 12, 12 *a*. Slots 60, 62 are formed in side wall 12 as are rim reinforcing members 36. Walls 12, 12*a* are formed with vertical structural beams 36 between upper rims 30, 30*a*, 30*b*, and lower rim 34. The base of the tote includes channels 64 that receive tote dividers and define base step down features 79 and base sections 74 on which the internal bins rest. Dividers 92, 94 are inserted into slots 64 to form a divided tote.

FIG. 6 shows the tote includes sidewalls 12 having recesses 60, 62 for retaining bin inserts within the tote. The sidewalls 12 and sidewalls 12*a* include slots 64 for retaining dividers 94. The bin insert may include any number of recesses 60, 62 or slots 64 in each side wall. Tote 10 includes reinforcing rim 30 and secondary rims 30*a*, 30*b* with rim reinforcements 32 formed on the upper portion of sidewalls 12, 12 *a*. Rim reinforcements 32 interconnecting rims 30, 30*a*, 30*b* provide a stiff and rugged tote for the bins. Slots 64 are formed in side wall 12 as are rim reinforcing members 36. Walls 12, 12*a* are formed with vertical structural beams 36 between upper rims 30, 30*a*, 30*b*, and lower rim 34. The base of the tote includes channels 64 that receive tote dividers and define base step down features 79 and base sections 74 on which the internal bins rest.

Figure 7:
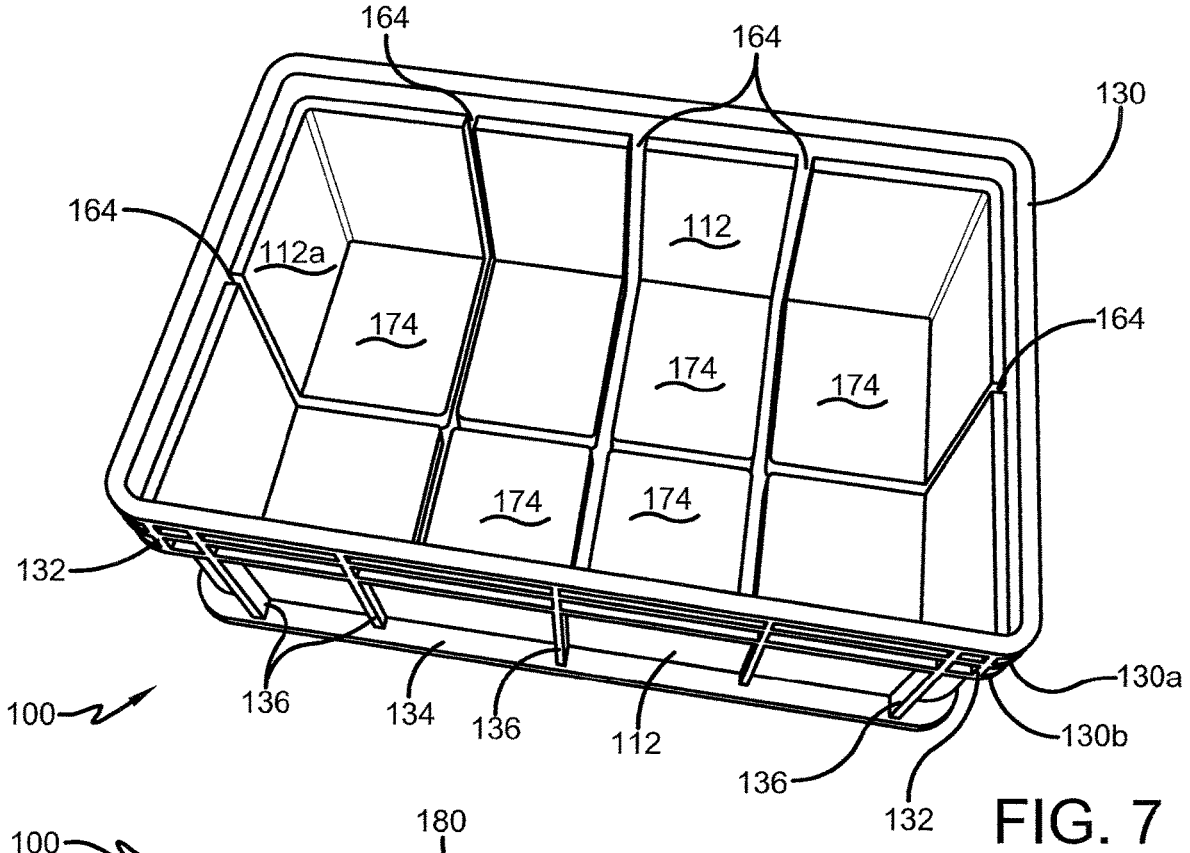
FIG. 7 illustrates an isometric view of a tote in another alternate embodiment of the present invention.
Figure 8:
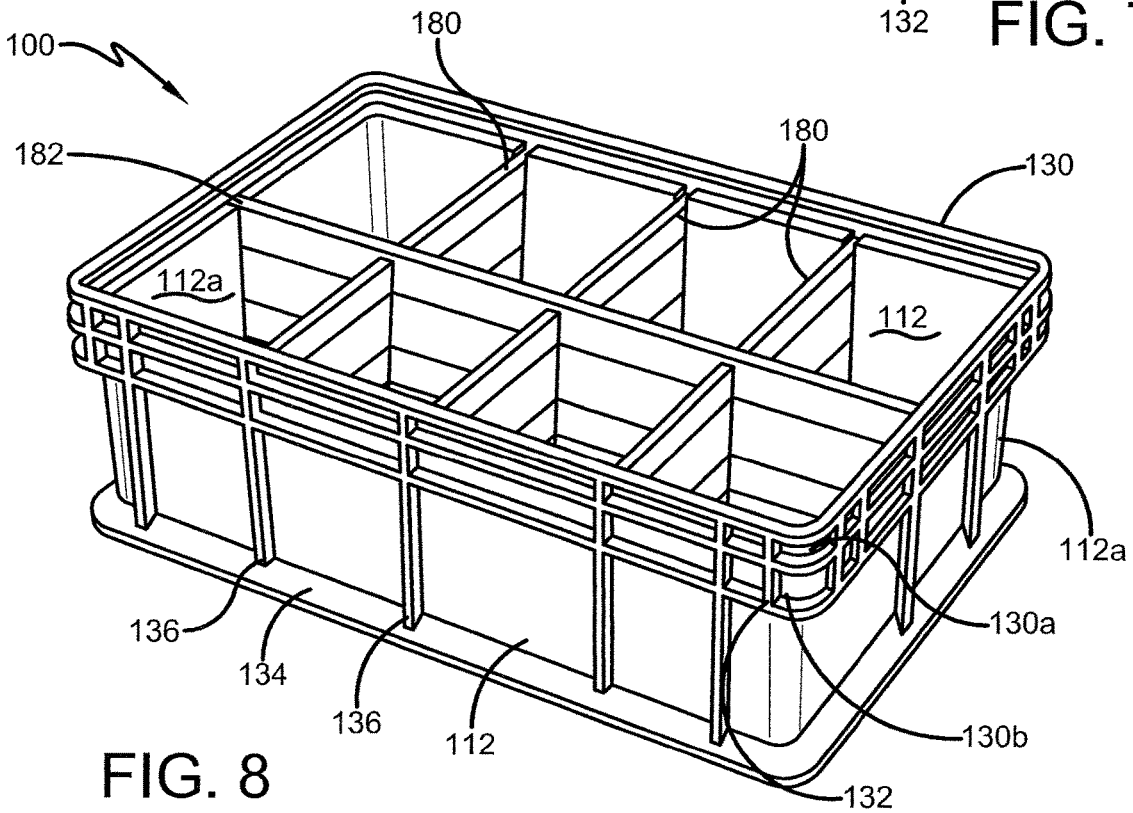
FIG. 8 illustrates an isometric view of a tote with dividers inserted in an alternate embodiment of the present invention.

Yet another embodiment of the invention is shown in FIG. 7 and FIG. 8 in which the tote 100 includes sidewalls 112 and sidewalls 112*a* include slots 164 for retaining dividers 180. The tote 100 may include any number of slots 164 in each side wall 112, 112*a*. Tote 100 includes reinforcing rim 130 and secondary rims 130*a*, 130*b* with rim reinforcements 132 formed on the upper portion of sidewalls 112, 112*a*. Slots 164 are formed in side wall 112 as are rim reinforcing members 132. Walls 112, 112*a* are formed with vertical structural beams 136 between upper rims 130, 130*a*, 130*b*, and lower rim 134. The base of the tote includes channels 164 that receive tote dividers 180, 182 and define base sections 174.

Another embodiment of the present invention is shown as a compartmentalizable, stackable tote system in FIGS. 9-11C. The tote system includes a tote 200 similar in structure and function to totes 10 and 100 illustrated in FIGS. 1-2A and 4-8, described above. As a result, the description below is directed to the differences in structure and operation between tote 200 illustrated in FIGS. 9-11C and totes 10 and 100 illustrated in FIGS. 1-6 and 7-8, respectively.

Figure 9:
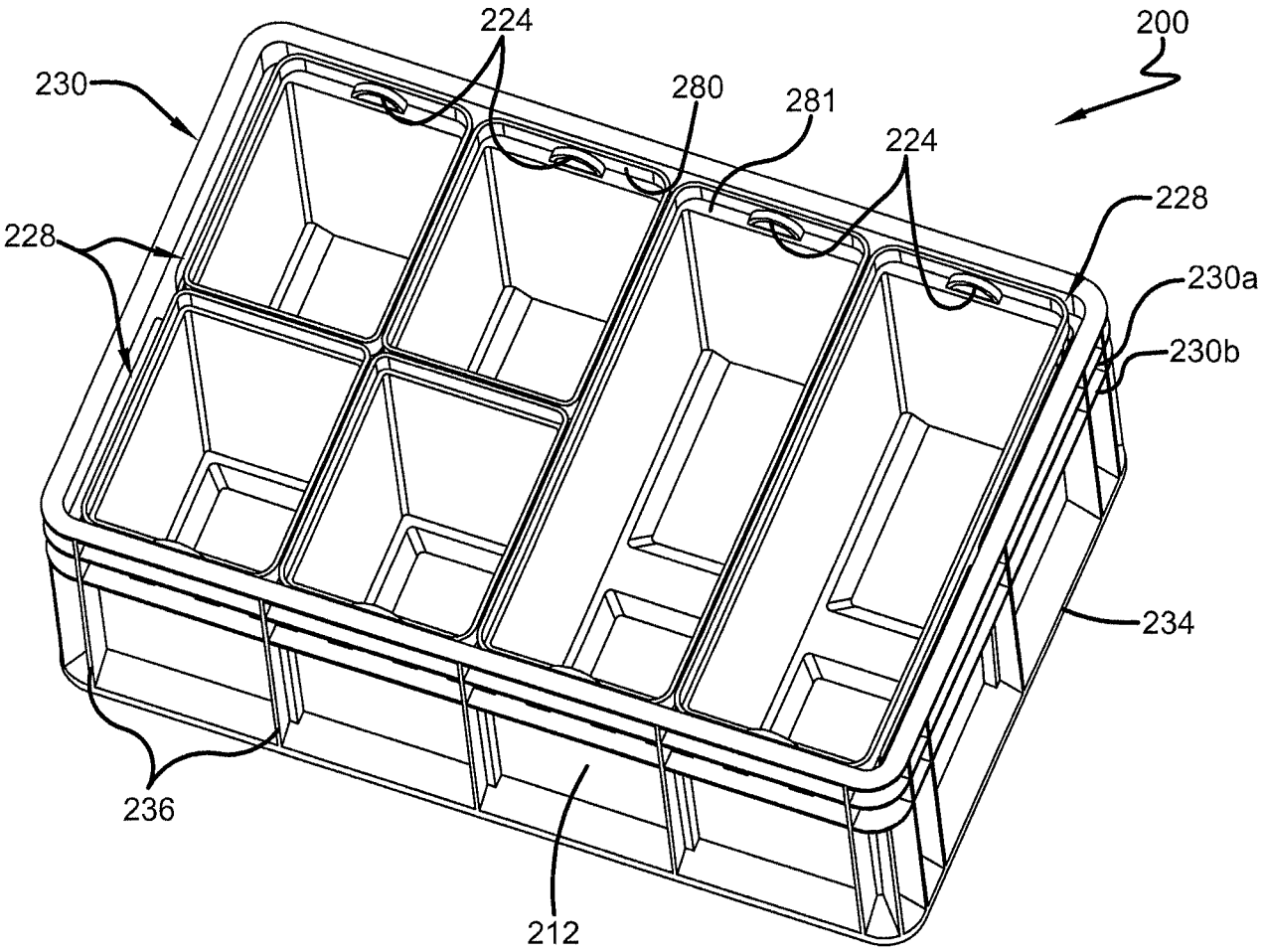
FIG. 9 illustrates a perspective view of another alternate embodiment of the present invention containing a number of bins.

Turning now to FIG. 9, the tote 200 is shown with a number of sidewalls 212 and a base 214 (FIG. 10A) and contains one or more bins 228. The tote 200 may include a reinforcing rim 230 and secondary rims 230*a* and 230*b* formed on the upper portion of sidewalls 212 and a lower rim 234. The base 214 is typically smaller than the inner edge of reinforcing rim 230 such that a second tote (not shown) may be stacked on tote 200 allowing the base of the second tote to be partially nested therein. The reinforcing rim 230; secondary rims 230*a*, 230*b*; and lower rim 234 cooperate with sidewalls 212 to provide ruggedness and increased stiffness to tote 200. The sidewalls 212 may also be formed with vertical structural beams 236 between upper rim 230; secondary rims 230*a*, 230*b*; and lower rim 234 to provide increased reinforcement when the tote 200 is stacked.

Figure 10:
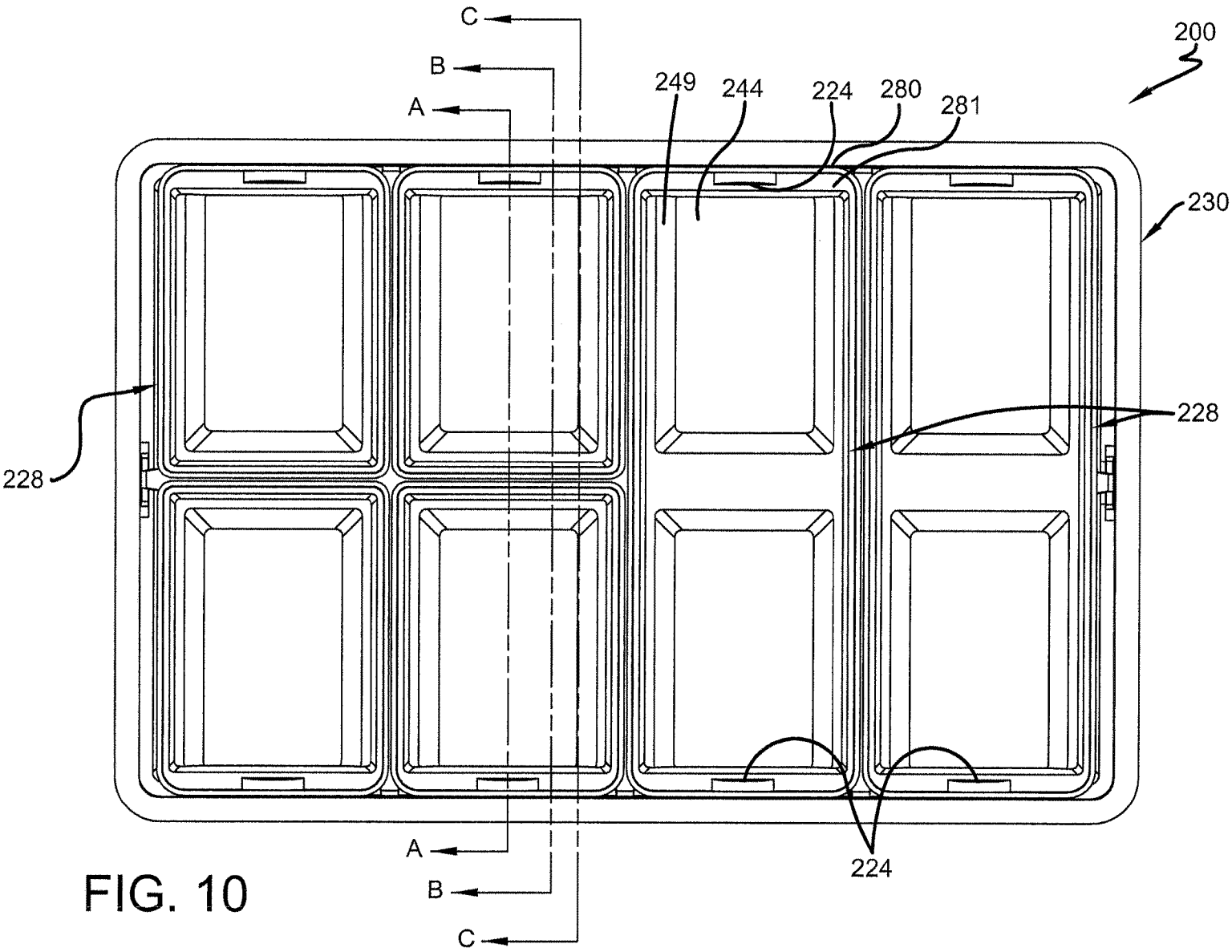
FIG. 10 illustrates a plan view of the alternate embodiment of the present invention as shown in FIG. 9 containing a number of bins.
Figure 10A:
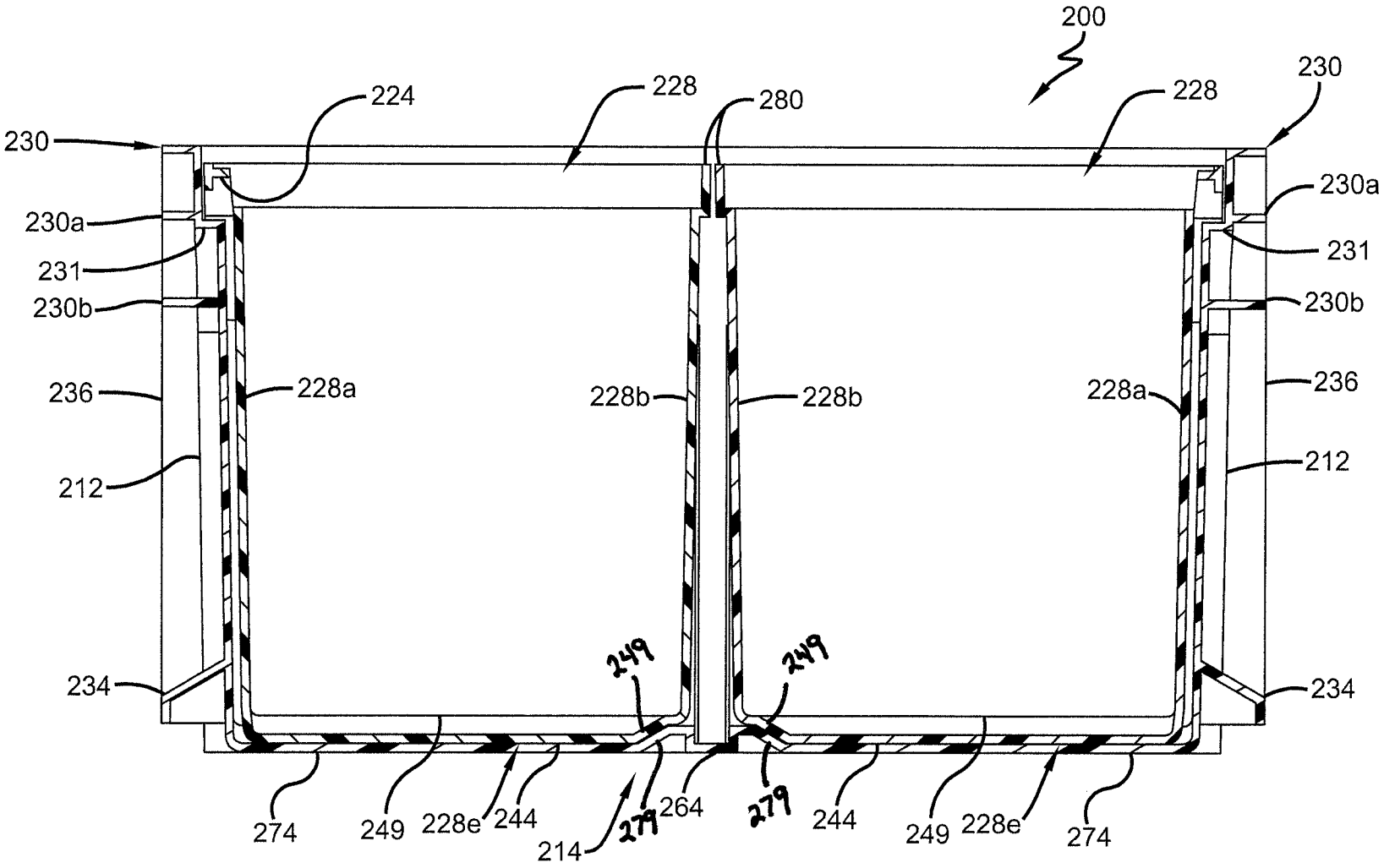
FIG. 10A illustrates a cross-sectional view of the alternative embodiment shown in FIG. 10 taken along line A-A.
Figure 11:
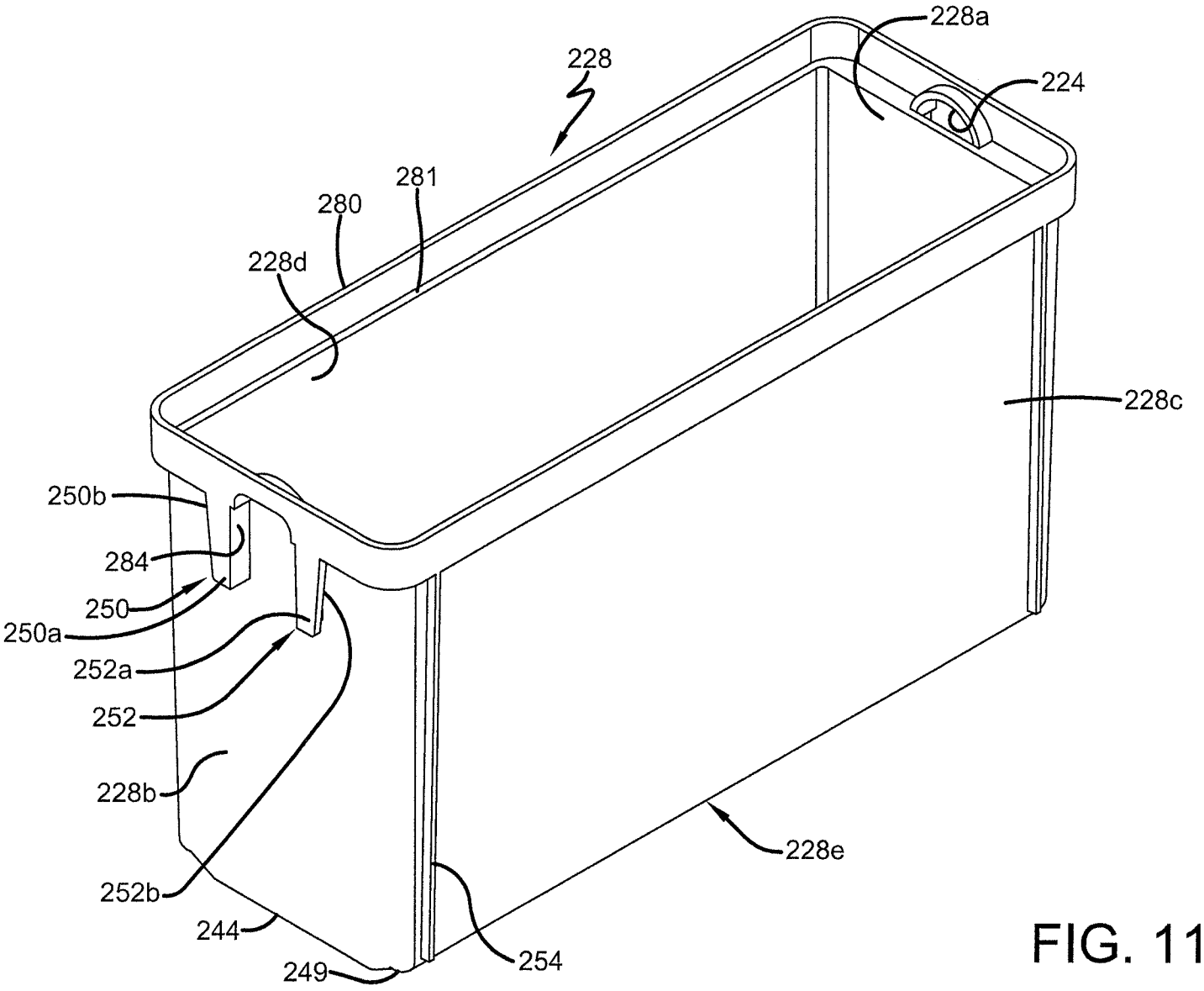
FIG. 11 illustrates a perspective view of a bin as shown in FIG. 10.
Figure 11B:
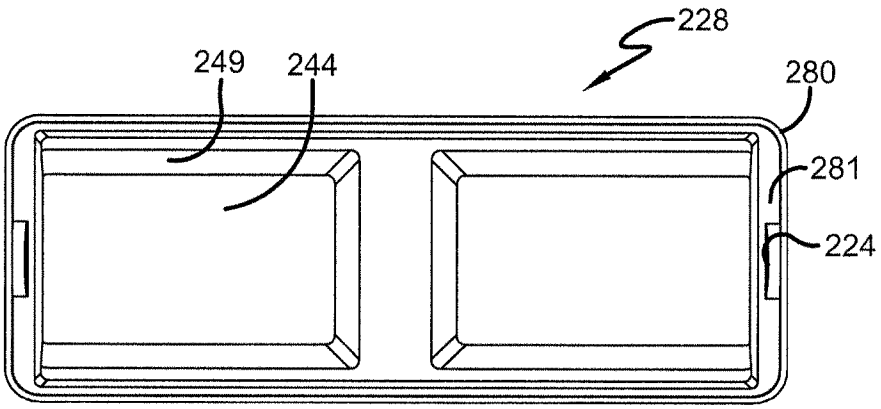
FIG. 11B illustrates a plan view of the bin shown in FIG. 11.
Figure 11C:
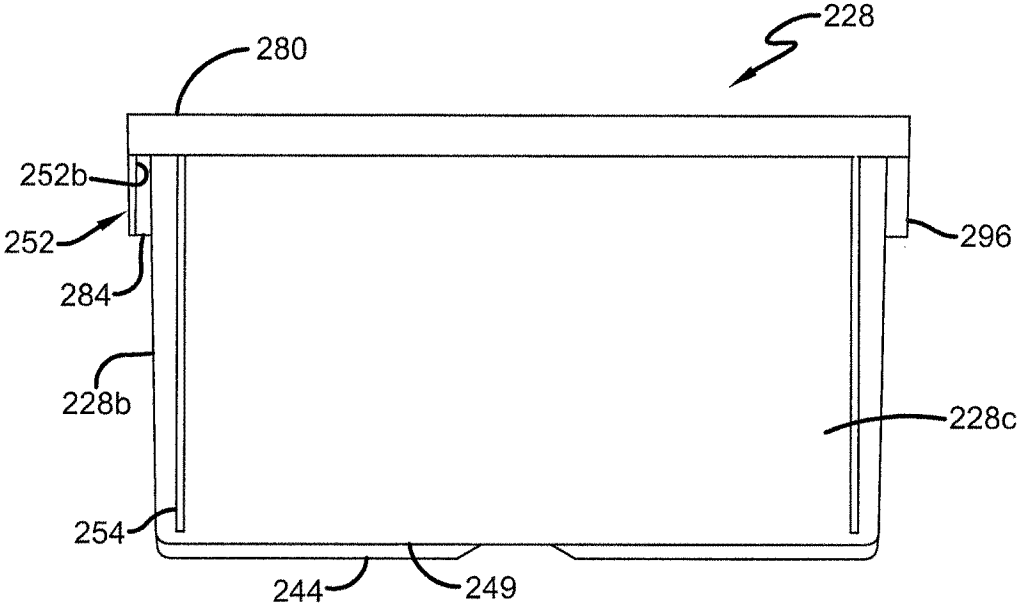
FIG. 11C illustrates an elevational view of the bin shown in FIG. 11.
Figure 11A:
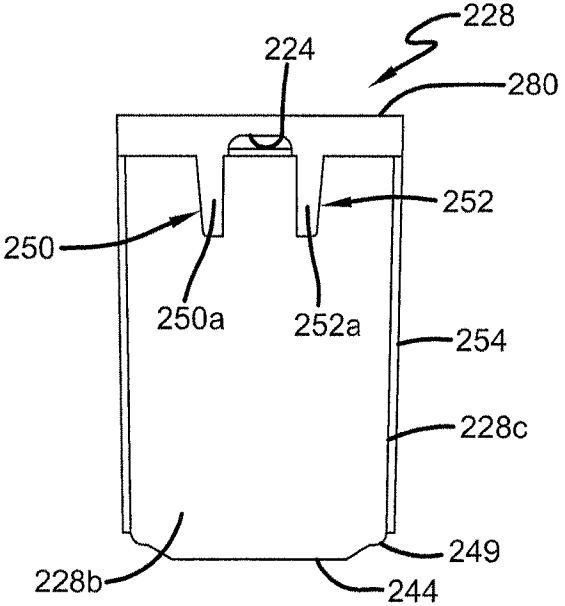
FIG. 11A illustrates an end view of the bin shown in FIG. 11.

Bin or bins 228 as shown in FIGS. 11-11C have a pair of end walls 228*a*, 228*b*; a pair of sidewalls 228*c*, 228*d*; and a base 228*e*. End walls 228*a*, 228*b* and sidewalls 228*c*, 228*d* have a continuous connected or integrally formed lip 281 that extends outward from the upper edge of the walls. An upper rim 280 is integrally formed or connected to and extends upward from lip 281. Upper rim 280, while increasing the overall height of bin 228, is configured such that, when the bin is placed in tote 200, it is downwardly recessed from reinforcing rim 230. The spacing of bins 228 below reinforcing rim 230 allows for tote 200 to be utilized in an automated stacking and retrieval system (not shown) which generally requires that the tote not have components sticking up above reinforcing rim 230. The spacing of bins 228 below reinforcing rim 230 of tote 200 also allows a base 274 (FIG. 10A) of a second tote (not shown) to nest partially within the first tote to promote easy stacking of one tote on top of another. Upper rim 280 or the upper rim and lip 281 may have an opening formed therethrough to form one or more handles 224. Handles 224 allow bins 228 to be gripped and removed from tote 200 with relative ease.

End walls 228*a*, 228*b* and sidewalls 228*c*, 228*d* may also include one or more vertically arranged spacers or stack ribs 254 extending outward from one or more of the sidewalls such that the outermost edge of the stack rib is level with or beyond upper rim 280. This allows stack ribs 254 of bin 228 to rest on the interior of lip 281 of a second bin (not shown). As a result, stack ribs 254 prevent bins 228 from fully nesting within the interior of each other or becoming jammed together when stacked. However, stack ribs 254 may be configured to allow bin 228 to be stacked on a second bin such that a portion of end walls 228*a*, 228*b*; sidewalls 228*c*, 228*d*; and base 228*e* are nested within the interior region of the second bin or surrounded by upper rim 280.

In accordance with another feature of the disclosed subject matter, one or both of end walls 228*a*, 228*b* or sidewalls 228*c*, 228*d*, or, alternatively, all of the end walls and sidewalls may have one or more pairs of retaining tabs 250, 252. Retaining tabs 250, 252 each include a respective face 250*a*, 252*a* integrally formed with or connected to upper rim 280. Faces 250*a*, 252*a* are also each integrally formed with or connected to a spacer 284. Spacers 284 are connected to or integrally formed on and extend outward from end walls 228*a*, 228*b*, or sidewalls 228*c*, 228*d*. Spacers 284 are also connected to or integrally formed on lip 281. Spacers 84 allow faces 250*a*, 252*a* to be disposed a distance from the respective wall or walls. As a result each retaining tab 250, 252 has a respective recess 250*b*, 252*b* (FIG. 11) formed between faces 250*a*, 252*a*; end walls 228*a*, 228*b* or sidewalls 228*c*, 228*d*; lip 281; and spacers 284. It should be apparent that recesses 250*b*, 252*b* may have varying depth or position or that more than one recess may be formed by each retaining tab 250, 252 depending upon the location of spacers 284 in relation to faces 250*a*, 252*a*. Retaining tabs 250, 252 may have any suitable shape. For example, retaining tabs 250, 252 may include a trapezoidal shape such that the retaining tabs are wider at the top and taper to a narrower width at the bottom. The results in easier insertion of bin 228 into tote 200 and improved stability once installed.

Alternatively, one or both of end walls 228*a*, 228*b* or sidewalls 228*c*, 228*d* or all of the end walls and sidewalls may have one or more pairs of stabilization tabs 296 (FIG. 10C) or a combination of stabilization tabs and retaining tabs 250, 252. Stabilization tabs 296 are similar in structure to retaining tabs 250, 252 but do not have faces 250*a*, 252*a*. Stabilization tabs 296 include spacers 84 integrally formed from and connected to end walls 228*a*, 228*b*, or sidewalls 228*c*, 228*d*, and lip 281 and extend outward from the walls. The outermost edge of spacers 84 may not extend beyond the outer surface of upper rim 280.

With particular reference to FIGS. 11-11C, base 228*e* of bin 228 may include one or more recessed areas 244. Recessed areas 244 may be partially or completely surrounded by raised channels or stepped features 249. Stepped features 249 generally have a sloping or curved profile extending upward from recessed area 244. Stepped features 249 may also be formed adjacent one another depending on the size of bin 228. As a result stepped features 249 may be of varying width and have a flat profile flanked by sloping or curved profiles.

Turning now to FIG. 10A, base 214 of tote 220 includes multiple recessed areas 274 and stepped features 279 (only a pair shown), which correspond and cooperate with recessed areas 244 and stepped features 249 of base 228*e* when bin 228 is placed within the tote. As a result, bin recessed area 244 rests on tote recessed area 274. Stepped feature 249 contacts tote base 214 stepped features 279 in a complementary fashion. Bin stepped features 249 and tote base stepped features 279 both have a sloped or curved profile extending upward from its respective recessed area 244, 274 such that, when placed in contact, the stepped features create a barrier preventing bin 228 from sliding out of the recessed areas.

Tote base 214 may also include one or more recesses or divider channels (not shown) formed therein. The divider channels may run the length, width, or both the length and width of base 214 at various intervals. The divider channels may be designed to hold dividers (not shown) of varying or uniform thickness such that the dividers are partially retained within the channels keeping the dividers upright in position. The divider channels may terminate at sidewalls 212 of tote 200 such that the dividers may abut or fit snugly against the walls. Alternatively, the divider channels may continue onto sidewalls 212 providing a vertical recess into which a divider end (not shown) may be partially recessed and held in position.

Figure 10B:
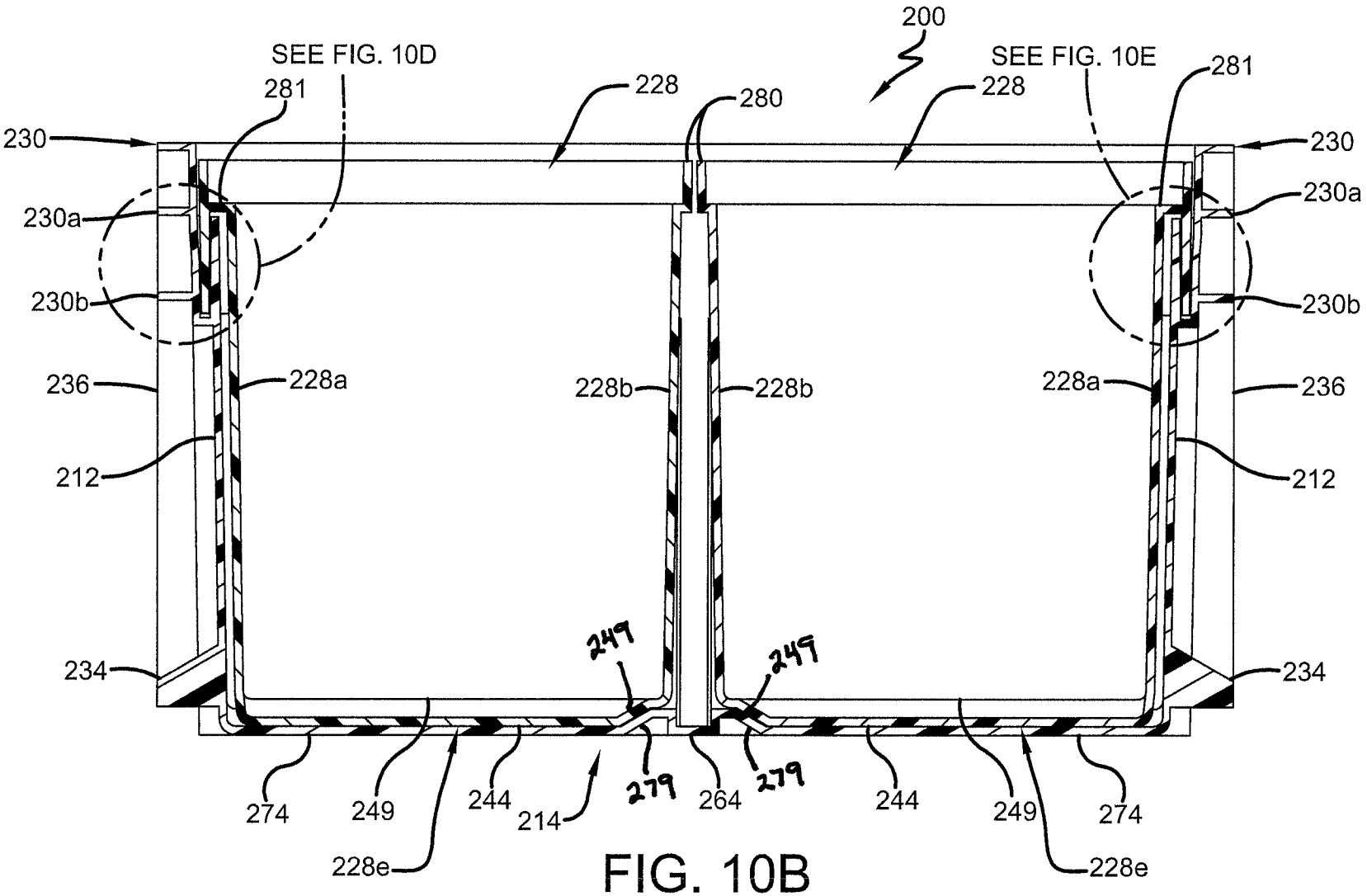
FIG. 10B illustrates a cross-sectional view of the alternative embodiment shown in FIG. 10 taken along line B-B.
Figure 10C:
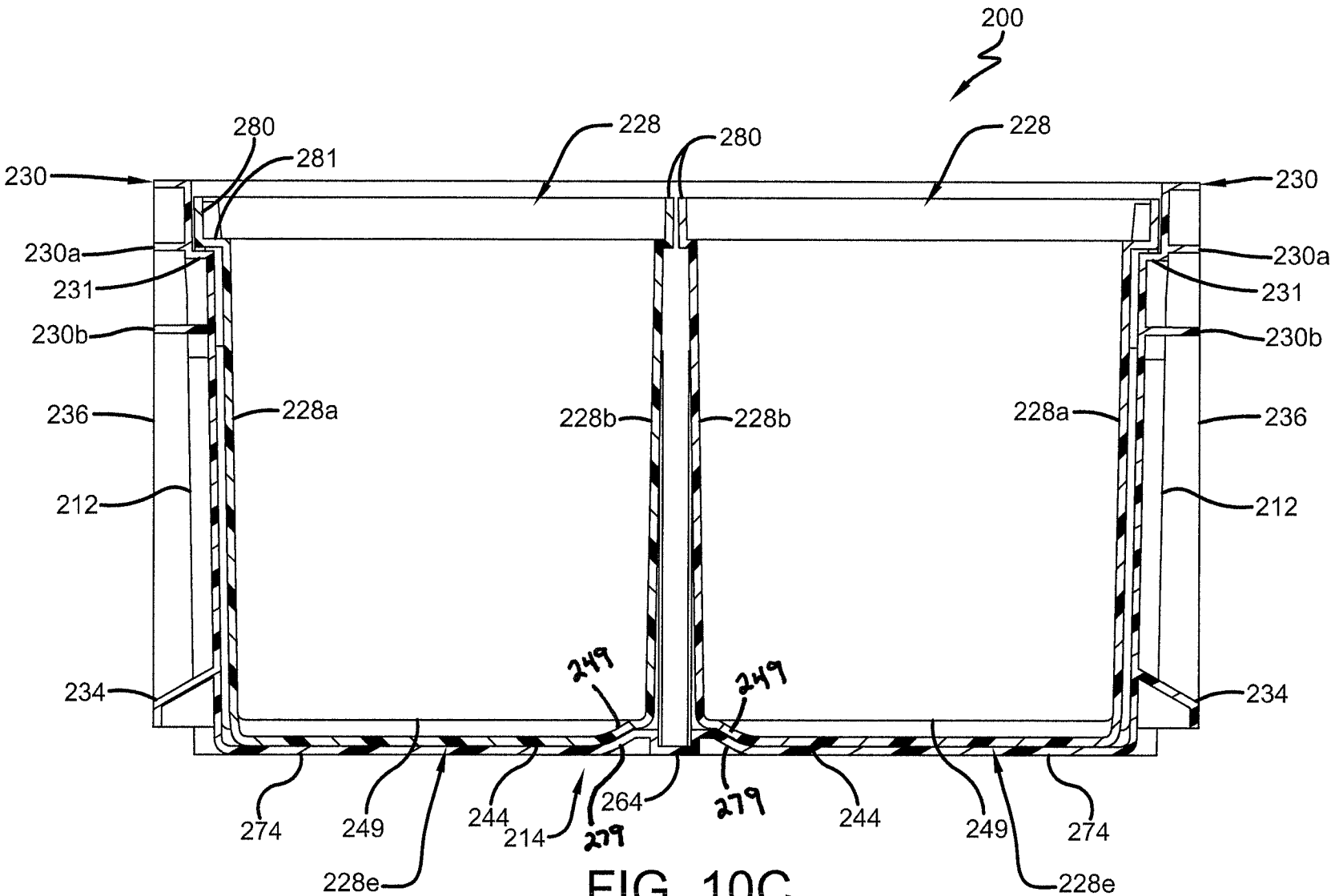
FIG. 10C illustrates a cross-sectional view of the alternative embodiment shown in FIG. 10 taken along line C-C.
Figure 10D:
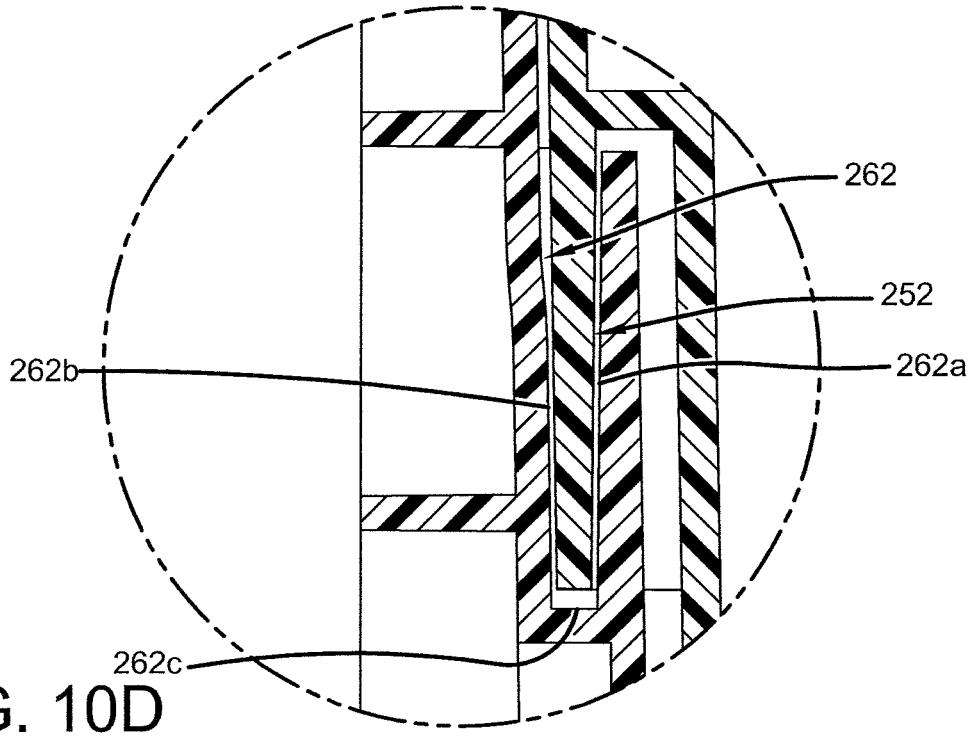
FIG. 10D illustrates an enlarged elevational view of the circled area shown in FIG. 10B marked "SEE FIG. 10D"
Figure 10E:
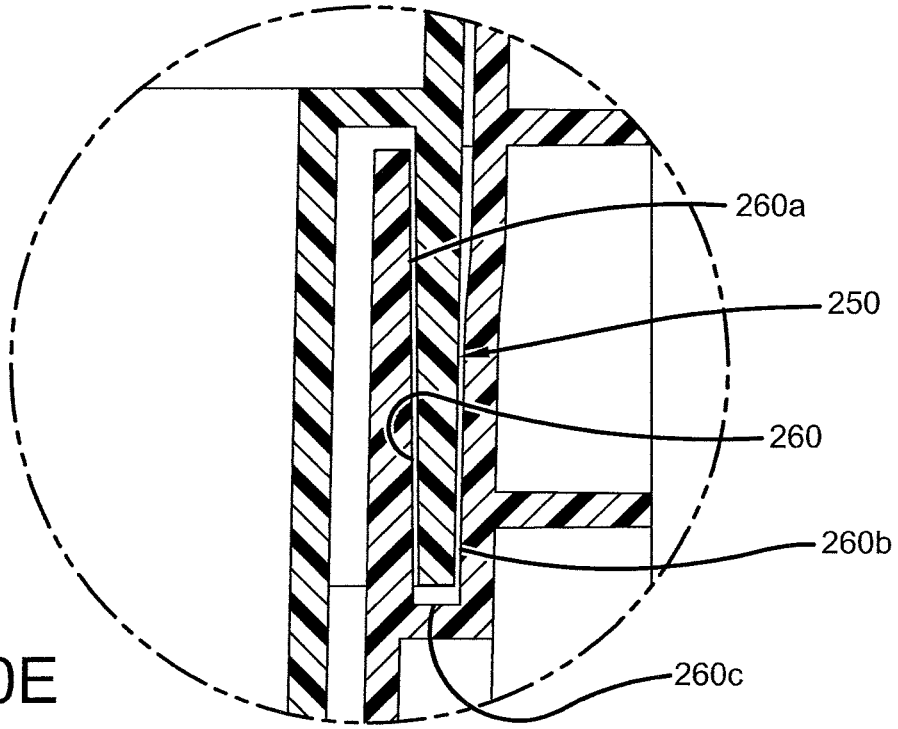
FIG. 10E illustrates an enlarged elevational view of the circled area shown in FIG. 10B marked "SEE FIG. 10E"

With particular reference to FIG. 10B, sidewalls 212 of tote 200 may also include a number of recesses or tab slots 260, 262 to receive retaining tabs 250, 252 of bins 228. Each tab slot 260, 262 includes a front wall 260*a*, 262*a*; side wall (not shown); back wall 260*b*, 262*b*; and distal wall 260*c*, 262*c*. Walls 260*a*, 262*a*, 260*b*, 262*b*, 260*c*, 262*c* enclose tab slot 260, 262 and form a ledge 231. Each retaining tab 250, 252 is received within tab slot 260, 262 such that spacer 284 is disposed between front wall 260*a* and sidewall 212. Alternatively, sidewalls 212 may include divider channel 264 disposed through tab slots 260, 262 such that the divider channel may be defined by front walls 260*a*, 262*a*; side walls; and back walls 260*b*, 262*b*.

The totes and bins may be formed by any suitable method typically thermoforming, injection molding, blow molding and rotocasting are used for totes and bins.

The present invention should not be considered limited to the specific examples described herein, but rather should be understood to cover all aspects of the invention. Various modifications, equivalent processes, as well as numerous structures and devices to which the present invention may be applicable will be readily apparent to those of skill in the art. Those skilled in the art will understand that various changes may be made without departing from the scope of the invention, which is not to be considered limited to what is described in the specification.

What is claimed is:

1. A tote for use in a compartmentalizable tote and bin system comprising:

a tote base having a plurality of recessed areas, each of the plurality of recessed areas having one or more raised peripheral boundaries capable of complementary cooperation with a bin of said compartmentalizable tote and bin system;

a first tote side wall and a second tote side wall; and first and second tote end walls, the first and second tote side walls and first and second tote end walls each having an interior surface and an exterior surface with edge surfaces between the interior and exterior surfaces, defining a plurality of slotted recesses for retaining said bin within the tote, each of said plurality of slotted recesses having a front wall and a back wall, said front wall and said back wall being parallel with said first tote side wall;

wherein the tote base, the tote side walls and tote end walls define a tote interior.

2. A compartmentalizable tote and bin system comprising:

a tote having:

a tote base including a plurality of recessed areas, each of the plurality of recessed areas having one or more raised peripheral boundaries;

a first tote side wall including a plurality of slotted recesses for retaining a bin within the tote, each of said plurality of slotted recesses having a front wall and a back wall parallel with said first tote side wall;

and a second tote side wall;

first and second tote end walls, the tote side walls and tote end walls forming a tote rim, wherein the tote base, the tote side walls and tote end walls defining a tote interior;

the first tote side wall having an interior surface and an exterior surface with edge surfaces between the interior and exterior surfaces, defining said plurality of slotted recesses; and a bin having:

a bin base including one or more recessed areas, each of the one or more bin base recessed areas having one or more raised peripheral boundaries, the one or more bin base recessed areas cooperating with the plurality of recessed areas of the tote base to limit sliding between the bin and the tote;

a first bin side wall;

a second bin side wall;

first and second bin end walls, the bin side walls and bin end walls having an upper rim, wherein the bin base, bin side walls and bin end walls defining a bin interior; and at least one tab having a portion substantially tangential to and formed on the exterior of at least a first bin side wall, the tab being suitable for insertion into a selected one of the plurality of slotted recesses between said front wall and back wall of said slotted recesses;

wherein the bin is capable of being disposed within the tote interior such that the upper rim of the bin is recessed relative to the tote rim.

3. The compartmentalizable tote and bin system of claim 1, wherein the at least one tab further comprises a riser substantially normal to the first bin side wall;

wherein the portion substantially tangential to the first bin side wall is trapezoidal, formed with the riser, and spaced apart from the first bin side wall.

4. The compartmentalizable tote and bin system of claim 1 wherein the plurality of slotted recesses further comprise:

a channel in the tote side wall interior surface;

and edge surfaces between the tote side wall interior surface and tote side wall exterior surface, whereby the tote side wall interior surface, the tote side wall exterior surface, and the edge surfaces define a trapezoidal recess.

5. The compartmentalizable tote and bin system of claim 1, wherein the second tote sidewall includes a second plurality of slotted recesses for retaining the bin within the tote.

* * * * *